United States Patent [19]

Lakin

[11] Patent Number: 4,665,875

[45] Date of Patent: May 19, 1987

[54] LIQUID FUEL PUMPING APPARATUS

[75] Inventor: David F. Lakin, Gloucester, England

[73] Assignee: Lucas Industries Public Limited Company, Birmingham, England

[21] Appl. No.: 802,307

[22] Filed: Nov. 27, 1985

[30] Foreign Application Priority Data

Dec. 20, 1984 [GB] United Kingdom ..... 8432310

[51] Int. Cl.[4] ..... F02M 39/02

[52] U.S. Cl. ..... 123/449; 123/506

[58] Field of Search ..... 123/449, 446, 447, 506

[56] References Cited

U.S. PATENT DOCUMENTS

| | | | |
|---|---|---|---|
| 3,358,662 | 12/1967 | Kulke | 123/449 |
| 3,538,897 | 11/1970 | Konrath | 123/449 |
| 4,170,974 | 10/1979 | Kopse | 123/449 |
| 4,271,808 | 6/1981 | Kobayashi | 123/449 |
| 4,327,696 | 5/1982 | Kobayashi | 123/506 |
| 4,398,519 | 8/1983 | Tissot | 123/446 |
| 4,409,939 | 10/1983 | Eheim | 123/449 |
| 4,510,908 | 4/1985 | Elsele | 123/449 |
| 4,542,725 | 9/1985 | Yasuhara | 123/449 |

FOREIGN PATENT DOCUMENTS

| | | | |
|---|---|---|---|
| 2131102 | 6/1984 | United Kingdom | 123/449 |

*Primary Examiner*—Ronald B. Cox

[57] ABSTRACT

A liquid fuel pumping apparatus for supplying fuel to an internal combustion engine includes a plunger slidable within a bore to which can be connected an outlet which in use is connected to an injection nozzle. The bore can also be connected to a drain through a spill valve, the spill valve when open allowing fuel to spill from the bore instead of flowing to the outlet. The spill valve includes a valve member which when the spill valve is open closes off the connection between the outlet and the bore.

5 Claims, 1 Drawing Figure

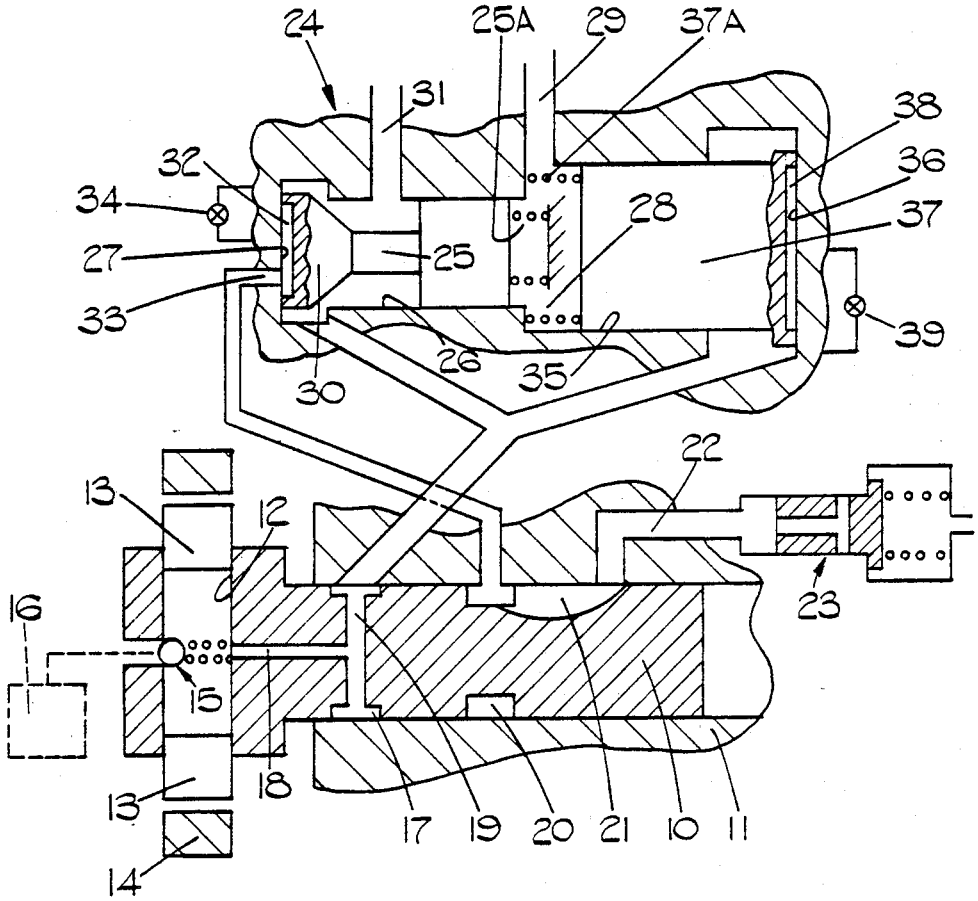
24
25A
29
37A
31
38
32
36
34
28
37
27
25
33
39
26
35
30
22
13
12
23
16
15
18
13
17
19
20
21
10
11
14

LIQUID FUEL PUMPING APPARATUS

This invention relates to a fuel pumping apparatus for supplying fuel to an internal combustion engine and of the kind comprising a high pressure pump including a plunger reciprocable within a bore in timed relationship with the associated engine, a spill valve communicating with the bore and through which when the valve is open, fuel can spill from the bore during inward movement of the plunger and an outlet communicating with the bore for connection in use to a fuel injection nozzle of the associated engine, fuel being delivered through said outlet during inward movement of the plunger when said spill valve is closed.

With such an apparatus a problem can arise during inward movement of the plunger when the spill valve is open. It is found if the spill valve does not provide sufficient flow area, that the movement of the plunger can cause sufficient pressure to be generated in the pumping chamber to cause a delivery valve and/or a spring loaded valve in an injection nozzle to be lifted from its seating. This can cause irregularity in the delivery of fuel and the object of the present invention is to provide an apparatus in a simple and convenient form.

According to the invention in an apparatus of the kind specified said spill valve includes a valve member which in the open position of the spill valve isolates said outlet from the bore.

An example of fuel pumping apparatus in accordance with the invention will now be described with reference to the accompanying drawing which is a diagrammatic sectional side elevation of the apparatus.

Referring to the drawing the apparatus comprises a rotary cylindrical distributor member 10 which is housed within a body 11 and which in use, is arranged to be driven in timed relationship with an associated engine. Formed in the distributor member is a transverse bore 12 in which is mounted a pair of reciprocable pumping plungers 13. The portion of the bore lying between the plungers constitutes a pumping chamber from which during inward movement of the plungers, fuel is expelled as will be explained. The plungers are arranged to be moved inwardly by means of cam lobes formed on the internal peripheral surface of a surrounding annular cam ring 14 and they may be moved outwardly in a positive manner by a mechanism not shown. Communicating with the pumping chamber by way of a nonreturn valve 15, is a low pressure fuel supply pump. Moreover, the pumping chamber communicates with a circumferential groove 17 formed on the periphery of the distributor member by way of an axial passage 18 and radial passages 19.

Also formed on the distributor member is a further circumferential groove 20 which at one position communicates with a single longitudinal groove 21 which is positioned to register in turn with a plurality of outlets 22 only one of which is shown. Each outlet incorporates an unloading delivery valve 23 of known construction and the downstream end of the delivery valve is connected in use to a fuel injection nozzle of the associated engine. The communication of the groove 21 with an outlet 22 is arranged to occur during the whole time the plungers 13 are moved inwardly.

Lccated in the body 11 is a spill valve generally indicated at 24. The spill valve comprises a valve member 25 which is slidable within a bore 26 one end of which is closed by an end wall 27 and the other end of which is open to a chamber 28 which communicates with a drain by way of a passage 29. The end portion of the bore 26 adjacent the end wall 27 is of enlarged diameter and is in communication with the circumferential groove 17. The step defined between the bore 26 and the enlarged portion thereof constitutes a seating for a valve head 30 which is located in the enlarged portion of the bore. Beneath the head the valve member 25 is of reduced diameter and the annular space so defined communicates with the aforesaid drain or with the outlet of the low pressure pump 16, by way of a passage 31. The valve member 25 is spring loaded by a spring 25A into sealing engagement with the end wall 27 and formed in the valve head is a recess 32. Formed in the end wall 27 is a port 33 which communicates with the circumferential groove 20 and the port 33 in the closed position of the valve member 25, is covered by the head 30. Also formed in the end wall at a position to communicate with the recess 32 is a further port and which by way of an electrically operable valve 34 can be placed in communication with the enlarged portion of the bore 26.

Also provided is a further bore 35 which is larger in diameter than the bore 26 and which has a closed end wall 36. The opposite end of the bore 35 opens into the chamber 28. At its end adjacent the end wall 36 the bore 35 is of enlarged diameter and this portion of the bore communicates with the circumferential groove 17. Slidable in the bore 35 is a piston 37 which has an enlarged portion at its end presented to the end wall 36 and in which there is defined a recess 38. The piston is biased by a spring 37A towards the end wall 36. A second electrically operable valve 39 is provided which connects a port opening onto the end wall 36 at a position to communicate with the recess 38, with the enlarged portion of the bore 35.

The valves 34 and 39 are constructed so that when the valves are de-energised, the respective recesses 32 and 38 are at a low pressure such as drain pressure.

Considering now the operation of the apparatus and assuming that the valve 24 and the piston 37 are in the position shown in the drawings. As the plungers 13 are moved inwardly, fuel will be displaced from the bore 12 and will flow past the spill valve and will flow to the drain by way of the passage 31. The spill valve member 25 remains in the position shown under the action of the spring 25A and because the recess 32 will be at a low pressure. The valve head 30 since it is in engagement with the end wall 27 covers the port 33 and therefore the groove 21 and the connected outlet 22 is isolated from the pumping chamber of the injection pump. When it is required to deliver fuel to the engine, the valve 34 is energised so as to connect the recess 32 with the pressure of fuel in the enlarged portion of the bore 26. In this situation the valve member 25 moves against the action of the spring 25A and this valve head moves into contact with the seating thereby preventing further spillage of fuel. In addition, the port 33 is placed in communication with the circumferential groove 17 so that fuel now flows by way of the groove 21 to the connected outlet 22. Such flow of fuel causes the delivery valve 23 to be lifted and supply of fuel to the associated engine nozzle takes place. Delivery of fuel can take place so long as the plungers 13 are moved inwardly.

When during inward movement of the plungers, it is required to terminate delivery of fuel the electrically operated valve 39 is energised to admit fuel under pressure to the space 38 and this causes movement of the piston 37 against the action of the spring 37A. Such movement reduces the pressure of fuel supplied to the associated outlet 22 with the result that the valve in the injection nozzle closes, the delivery valve closes and no further fuel is delivered to the associated engine. When the inward movement of the plungers 13 ceases the pressure in the circumferential groove 17 falls and the valve member 25 and the piston 37 can assume the position in which they are shown under the action of the respective springs. During the return motion of the piston 37 fuel will be returned to the bore. It will of course be appreciated that the valves 34 and 39 are allowed to assume their closed positions ready for the next inward movement of the plungers which takes place after continued rotation of the distributor member and when the groove 21 has moved into register with the following outlet 22. During outward movement of the plungers 13, fuel also flows from the low pressure pump 16 into the bore 12 by way of the non-return valve 15.

By the arrangement described the pressure generated during the initial inward movement of the plungers before the spill valve is closed onto its seating, is isolated from the outlets 22. This enables the lift of the spill valve to be reduced so that the pressure in the bore can be high and this ensures rapid movement of the valve member 25 when the valve 34 is energised.

I claim:

1. A fuel pumping apparatus for supplying fuel to an internal combustion engine comprising a high pressure pump including a plunger reciprocable within a bore in timed relationship with the associated engine, a spill valve communicating with the bore and through which when the valve is open, fuel can spill from the bore during inward movement of the plunger, an outlet communicating with the bore for connection in use to a fuel ihnjection nozzle of the associated engine, fuel being delivered through said outet during inward movement of the plunger when said spill valve is closed, said spill valve including a valve member which in the open position of the spill valve isolates said outlet from the bore, said valve member being slidable in a spill bore, an end wall closing one end of said spill bore, said spill bore having an enlarged portion at said one end, said valve member defining a head in said enlarged portion of the spill bore and the valve member being of reduced size adjacent said head, a seating defined between the enlarged portion of the spill bore and the remaining portion thereof, said head in the closed position of the valve co-operating with the seating to prevent spillage of fuel, first passage means connecting said enlarged portion of the spill bore with said first mentioned bore, second passage means connecting said spill bore with a drain, and third passage means connecting said outlet to a port in said end wall and which in the closed position of said spill valve is covered by the head of the valve member.

2. An apparatus according to claim 1 including resilient means biasing said head into contact with said end wall, a recess defined in the face of the valve member presented to said end wall and valve means for admitting fuel under pressure into said recess when it is required to move the spill valve to the closed position to prevent spillage of fuel.

3. An apparatus according to claim 2 including a further port in said end wall, said valve means acting to control communication between said further port and said enlarged portion of the spill bore.

4. An apparatus according to claim 3 in which said valve means when preventing communication between said further port and the enlarged portion of the spill bore places said further port in communication with a drain.

5. An apparatus according to claim 4 including a non-return valve through which fuel can flow into said first mentioned bore from a source of fuel under pressure.

* * * * *